United States Patent [19]

Mongia et al.

[11] Patent Number: 4,567,724

[45] Date of Patent: Feb. 4, 1986

[54] VARIABLE GEOMETRY COMBUSTOR APPARATUS AND ASSOCIATED METHODS

[75] Inventors: Hukam C. Mongia; Edwin B. Coleman, both of Tempe; Thomas W. Bruce, Phoenix, all of Ariz.

[73] Assignee: The Garrett Corporation, Los Angeles, Calif.

[21] Appl. No.: 620,219

[22] Filed: Jun. 13, 1984

Related U.S. Application Data

[62] Division of Ser. No. 400,579, Jul. 22, 1984.

[51] Int. Cl.[4] ..... F02C 7/00; F02C 7/22

[52] U.S. Cl. ..... 60/39.06; 60/733; 60/742

[58] Field of Search ..... 60/39.02, 39.23, 39.36, 60/39.38, 39.826, 732, 733, 740, 742, 746, 748, 752, 39.06

[56] References Cited

U.S. PATENT DOCUMENTS 2,227,666 1/1941 Noack ..... 60/39.23

4,192,139 3/1980 Buchheim ..... 60/39.826

4,420,929 12/1983 Jorgensen et al. ..... 60/733

4,459,803 7/1984 Marshall ..... 60/39.23

FOREIGN PATENT DOCUMENTS 894054 4/1962 United Kingdom ..... 60/748

OTHER PUBLICATIONS

Carlstrom et al., "Improved Emissions Performance in Today's Combustion System", paper presented at AEG/SOA International Seminar; Athens, Greece, Jun. 1978.

*Primary Examiner*—Louis J. Casaregola

*Attorney, Agent, or Firm*—J. Richard Konneker; Albert J. Miller

[57] ABSTRACT

The fuel nozzles in a variable geometry combustor cooperate with an inwardly projecting liner wall section to define a sheltered pilot combustion zone within the liner. Simultaneously operable inlet valves are provided for admitting a selectively variable quantity of combustion air into the pilot zone.

7 Claims, 5 Drawing Figures

VARIABLE GEOMETRY COMBUSTOR APPARATUS AND ASSOCIATED METHODS

The Government has rights in this invention pursuant to Contract No. F33615-79-C-2000 awarded by the U. S. Air Force.

This is a division of application Ser. No. 400,579 filed July 22, 1984.

BACKGROUND OF THE INVENTION

The present invention relates generally to combustors utilized in gas turbine propulsion engines. More particularly, this invention provides variable geometry combustor apparatus, and associated methods, for imparting significantly improved stability and ignition performance to high-temperature rise combustion systems employed in advanced gas turbine aircraft propulsion engines.

Continuing evolution and improvements in combustor design have resulted in highly efficient fixed geometry combustors for conventional aircraft gas turbine propulsion engines. However, it is well known that such conventional combustors have significant limitations and disadvantages when utilized in the propulsion engines of ultra-high performance aircraft operating within expanded altitude-mach number flight envelopes. Among the more critical of these recognized combustor deficiencies arising from flight envelope expansion are combustion instability, high altitude relight difficulties and ground ignition problems at low ambient temperatures.

Accordingly, it is an object of the present invention to provide improved combustor apparatus, and associated methods, which eliminate or minimize above-mentioned and other limitations and disadvantages associated with conventional fixed geometry combustors.

SUMMARY OF THE INVENTION

In carrying out principles of the present invention, in accordance with a preferred embodiment thereof, a gas turbine propulsion engine is provided with a specially designed variable geometry combustor which is operable to significantly expand the altitude-mach number flight envelope within which the engine may be operated without experiencing the combustor lean instability and relight problems associated with conventional fixed geometry combustors.

The variable geometry combustor constituting the preferred embodiment is of an annular, reverse flow configuration, having a hollow, annular combustor liner which is surrounded by an intake plenum that receives high pressure discharge air from the engine's compressor section. The combustor liner has an annular upstream end wall through which a circumferentially spaced series of air inlet openings are formed.

Connected to the end wall at each of these inlet openings is one of a circumferentially spaced series of valve means for selectively admitting compressor discharge air into the combustion liner interior from the combustor plenum through the end wall openings. The valve means may be simultaneously opened or closed by actuation means positioned within the combustor inlet plenum and operable from the exterior of the combustor. Air entering the combustor liner interior through the spaced array of valve means has imparted thereto a swirl pattern having axial and tangential components by air swirler means positioned in each of the end wall inlet openings.

Positioned downstream from the liner end wall, and projecting generally radially into the liner interior (which serves as a combustion flow passage), are a circumferentially spaced series of fuel nozzle means. These fuel nozzle means, together with an inwardly projecting annular liner wall portion positioned generally radially opposite the nozzle array, define and partially separate axially adjacent, communicating annular pilot and main combustion zones within the liner interior, the primary zone being directly adjacent the liner end wall. Each of the nozzle means has two separately operable fuel spray outlets which respectively deliver atomized fuel in opposite axial directions into the pilot and main combustions zones. To provide a generally uniform exhaust temperature profile, dilution air from the combustor plenum is admitted to the combustion flow passage through annular arrays of inlet openings formed in the liner walls adjacent the upstream end of the main combustion zone.

During operation of the combustor, the opposed nozzle array and inwardly projecting liner wall portion uniquely cooperate to "shelter" the pilot combustion zone from adverse interaction with the main combustion zone. More specifically, even when combustion in the main zone is abruptly terminated (by, for example, a sudden throttling back of the engine which interrupts fuel flow through the main zone outlets of the nozzles), combustion in the pilot zone is substantially unaffected. The novel cooperative use of the nozzles and inwardly projecting liner wall portion thus greatly enhances the ignition stability of the combustor in all portions of the expanded flight envelope in which it may be operated.

Moreover, the ability, afforded by the simultaneously operable inlet valve means, to selectively terminate the swirler air inflow to the pilot combustion zone allows the selective maximization of the fuel richness of the fuel-air mixture therein. This feature of the invention substantially improves the high altitude relight, lean stability, and ground start capabilities of the combustor compared to conventional fixed geometry combustor apparatus.

DETAILED DESCRIPTION

Figure 1:
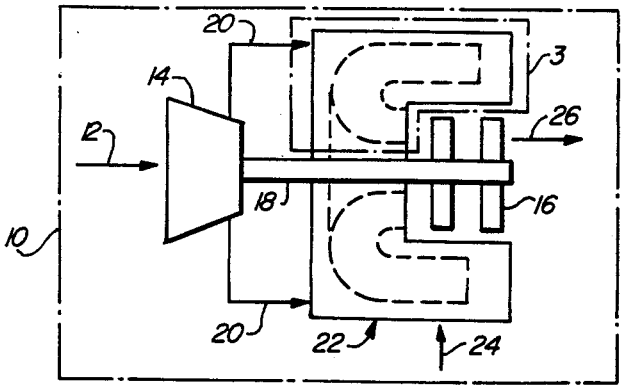
FIG. 1 is a greatly simplified schematic diagram of a gas turbine propulsion engine having a variable geometry combustor embodying principles of the present invention.

Schematically illustrated in FIG. 1 are the primary components of a gas turbine propulsion engine 10 which embodies principles of the present invention. During operation of the engine, ambient air 12 is drawn into a compressor 14 which is spaced apart from and rotationally coupled to a bladed turbine section 16 by an interconnecting shaft 18. Pressurized air 20 discharged from compressor 14 is forced into an annular, reverse flow combustor 22 which circumscribes the turbine section 16 and an adjacent portion of the shaft 18. The air 20 is mixed within the combustor with fuel 24, the resulting fuel-air mixture being continuously burned and discharged from the combustor across turbine section 16 in the form of hot, expanded gas 26. This expulsion of the gas 26 simultaneously drives the turbine and compressor, and provides the engine's propulsive thrust.

Figure 2:
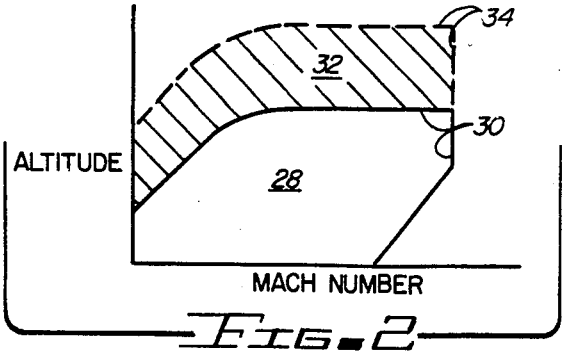
FIG. 2 is a graph illustrating the expanded flight envelope in which the engine may be operated due to the substantially improved ignition stability and relight capabilities of the combustor.

Conventional combustors used in aircraft jet propulsion engines are of fixed geometry construction and are designed to be operated only within a predetermined altitude-mach number flight envelope such as envelope 28 bounded by the solid line 30 in the graph of FIG. 2. If an attempt is made to operate the conventional combustor at higher altitudes or lower mach numbers than those within envelope 28 (i.e., within, for example, the crosshatched area 32 bounded by line 30 and dashed line 34 in FIG. 2), the ignition stability and altitude relight capabilities of the combustor are adversely affected. More specifically, if a conventional, fixed geometry combustor were to be operated within the representative flight envelope expansion area 32, the combustion process in the combustor would be subject to abrupt, unintended extinguishment, causing an equally abrupt engine power loss. Compounding this rather serious problem, substantial difficulty would normally be encountered in relighting the combustor until the aircraft dropped back into the normal flight envelope 28.

Not only is the upper boundary of a gas turbine propulsion engine's flight envelope limited by conventional fixed geometry combustor apparatus as just described, but certain other previously necessary combustor design compromises limit the engine's performance—even within the design flight envelope 28. One such limitation arising from the use of conventional fixed geometry combustors is the occurrence of engine ground starting difficulty—expecially at low ambient temperatures.

As will now be described with reference to FIGS. 3–5, the combustor 12 of the present invention is of a unique, variable geometry construction which permits the engine 10 to be efficiently and reliably operated within the substantially expanded flight envelope 28, 32 without these lean stability, altitude relight, or ground start problems of fixed geometry combustors.

Figure 3:
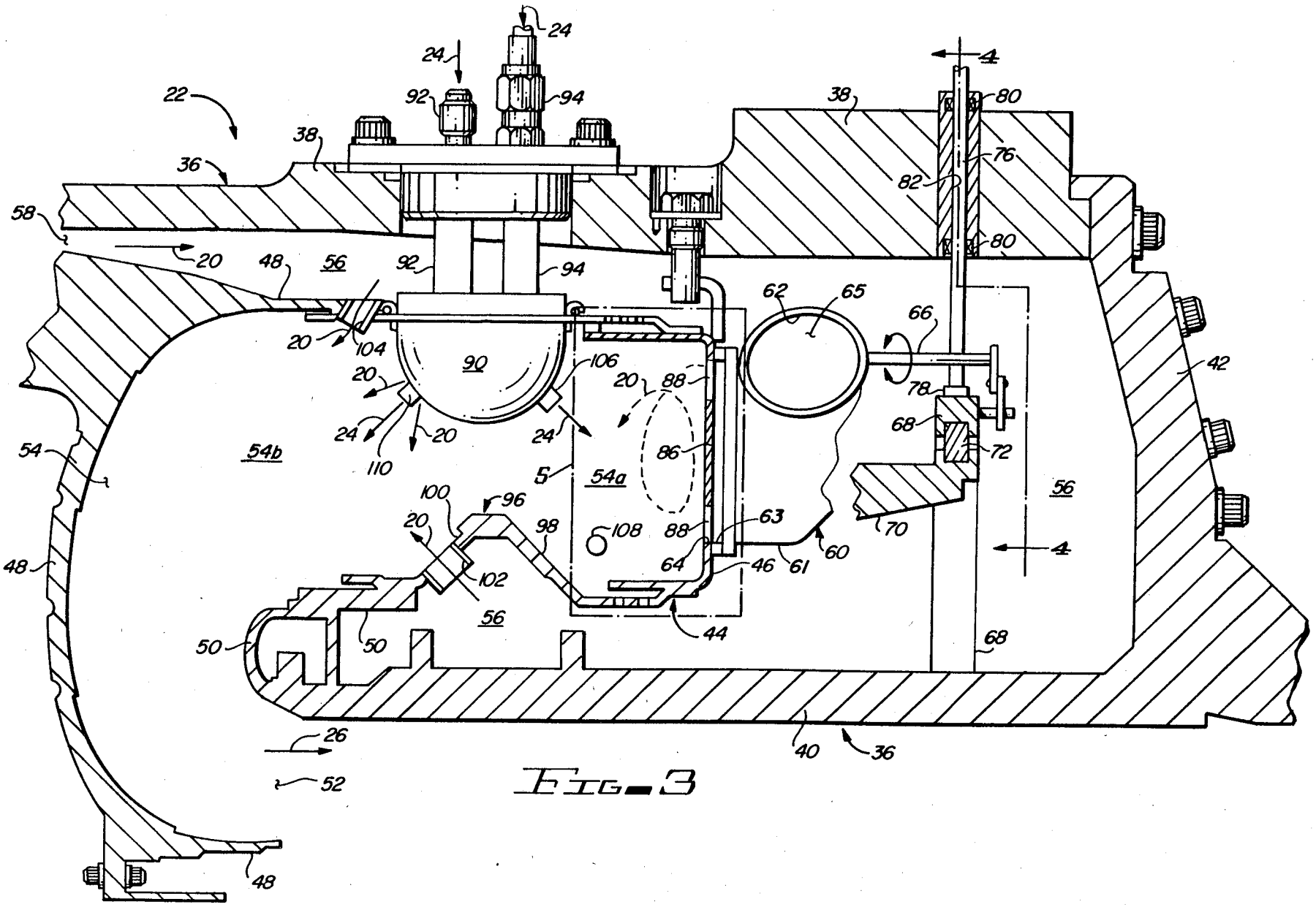
FIG. 3 is a greatly enlarged cross-sectional view through area 3 of the combustor of FIG. 1, with portions of the combustor interior details being broken away or omitted for illustrative clarity.

Referring to FIG. 3, the combustor 22 includes a hollow, annular outer housing 36 having an annular radially outer sidewall 38 and an annular, radially inner sidewall 40 spaced apart from and connected to sidewall 38 by an annular upstream end wall 42. Positioned coaxially within the housing 36 is an upstream end portion of an annular, hollow combustor liner 44 having a reverse flow configuration. Liner 44 has an annular upstream end wall 46 spaced axially inwardly from the housing end wall 42, and annular radially outer and inner sidewalls 48, 50 which extend leftwardly (as viewed in FIG. 3) from liner end wall 46 and then curve radially inwardly through a full 180°. At their downstream termination, the liner sidewalls 48, 50 define an annular discharge opening 52 through which the hot discharge gas 26 is expelled from the interior or combustion flow passage 54 of liner 44.

The interior of housing 36 defines an intake plenum 56 which circumscribes the upstream end portion of liner 44 as indicated in FIG. 3. Compressor discharge air 20 is forced into plenum 56 through an annular inlet opening 58 which circumscribes the liner 44 and is positioned at the left end of combustor 22. A portion of this pressurized air is used to cool the liner sidewalls 48, 50 during combustor operation. Although these sidewalls are, for the most part, shown in FIG. 3 as being of solid construction for the sake of clarity, they are actually of a conventional "skirted" construction. More specifically, as best illustrated in FIG. 5, the sidewalls 48, 50 have, along adjacent axial portions of their lengths, overlapping, radially spaced inner and outer wall segments **48*a*, 48*b* and 50*a*, 50*b*. To cool the walls 48, 50 air 20 is forced inwardly through openings 49, 51 formed respectively through the wall segments 48*b*, 50*b*. The entering air impinges upon the inner wall segments 48*a*, 50*a* and enters the combustion flow passage 54, in a downstream direction, through exit slots 48*c*, 50*c*** formed between the skirted wall segments.

Coimpressor discharge air 20 entering plenum 56 is selectively admitted to the liner combustion flow passage 54 through a circumferentially spaced series of spoon valves 60 (see also FIG. 4) positioned within the plenum 56 and connected externally to the liner end wall 46 around its circumference. Each of the valves 60 has an inlet opening 62 which faces generally tangentially relative to the liner end wall periphery, and an outlet which registers with one of a circumferentially spaced series of circular inlet openings 64 formed through the liner end wall 44 as best illustrated in FIG. 3.

Within each of the valves 60 is a flapper element (not shown) which may be opened and closed to regulate the air flow through the valve by means of an actuating rod 66. Each of the rods 66 extends axially toward the housing end wall 42 within plenum 56 and is pivotable about its axis to move its valve's flapper element between the open and closed positions.

Valves 60 may be simultaneously opened or closed by means of an actuation system which includes a unison ring 68 positioned coaxially within the plenum 56 between the valves 60 and the housing end wall 42. Unison ring 68 is rotatably supported within plenum 56 by a circumferentially spaced series of support brackets 70 positioned radially inwardly of the ring and secured to the liner end wall 46 as can best be seen in FIG. 4. Rotation of the unison ring is facilitated by carbon bearing blocks 72 carried by each of the brackets 70 and slidably received in a circumferential channel 74 (FIG. 3) formed in the radially inner surface of the ring.

To simultaneously open or close the valves 60, ring 68 is rotated by axial motion of a control rod 76 which is pivotally connected at its inner end to a connecting member 78 secured to the unison ring. Rod 76 is generally perpendicular to the axis of the unison ring and is angled relative to the ring's radius at connection point 78. From its inner end connection to member 78, rod 76 extends outwardly through the housing sidewall 38 through suitable bearing and seal members 80 positioned and retained within a circular bore 82 formed through such sidewall.

The selective axial motion of control rod 72 may be achieved by any desired conventional actuation means (not shown) positioned outside the combustor housing 36. Rotation of the ring 68 caused by such axial motion of control rod 76 is converted to simultaneous rotation of the valve actuation rods 66 by means of circumferentially spaced sets of linking members 82, 84 positioned adjacent the outer end of each of the actuation rods 66.

Figure 4:
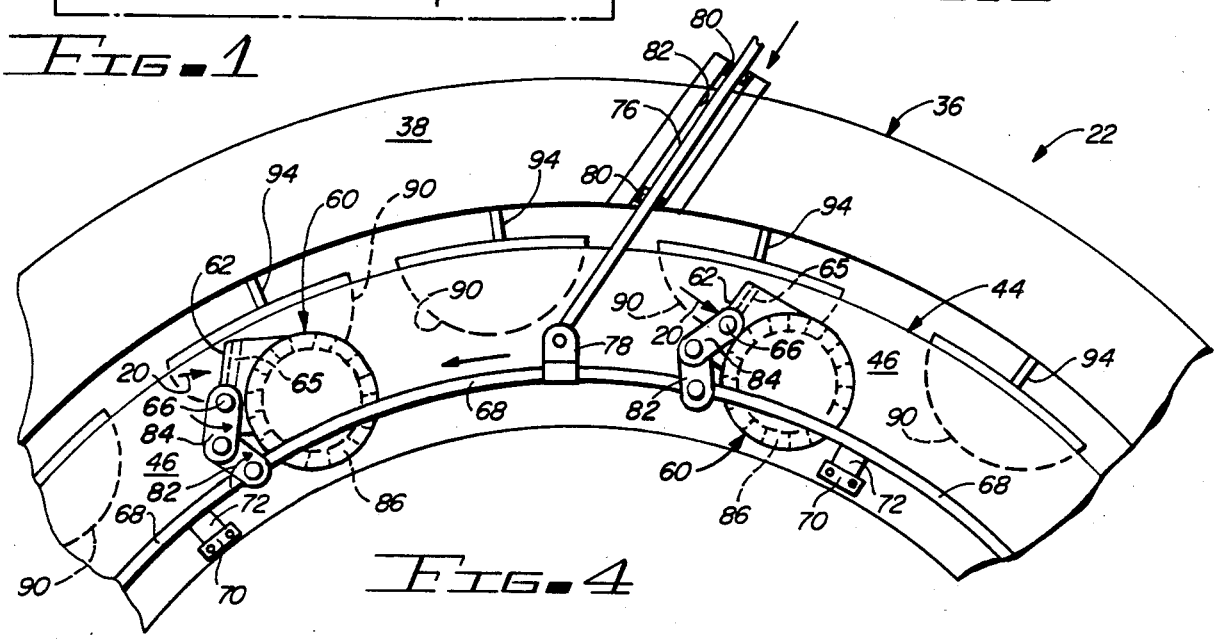
FIG. 4 is a reduced scale, fragmentary cross-sectional view of the combustor taken along line 4—4 of FIG. 3.
Figure 5:
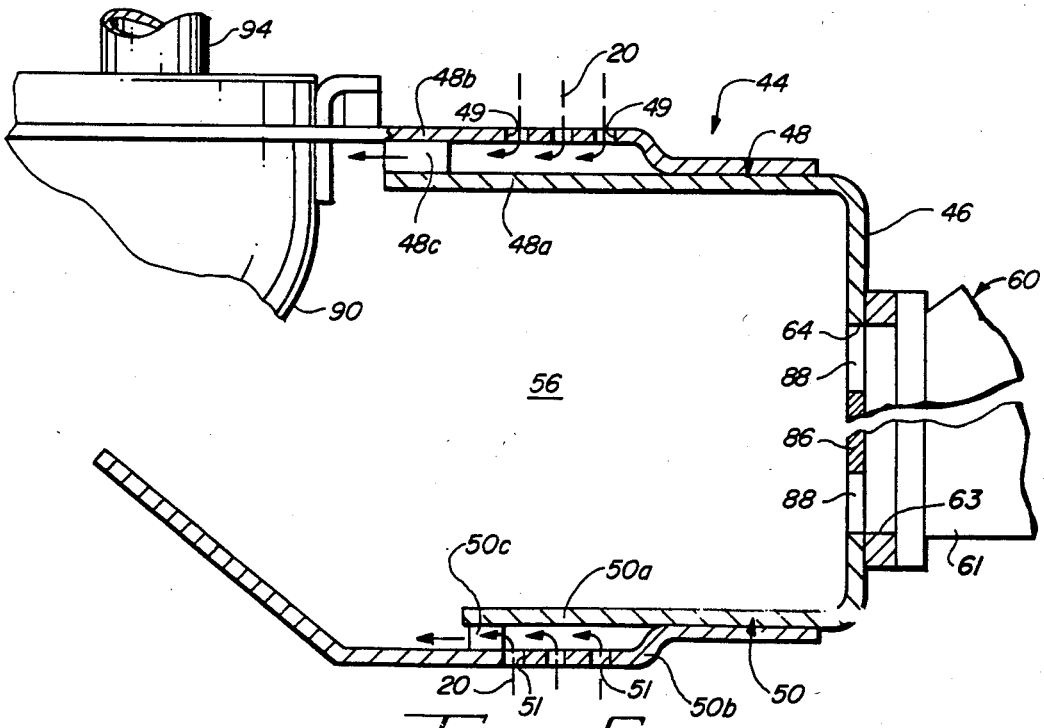
FIG. 5 is a fragmentary enlargement of the FIG. 3 cross-sectional area 5 of the combustor.

As can best be seen in FIG. 4, at each of the valves 60 the inner end of a linking member 82 is pivotally connected to the unison ring 68, the outer end of the member 82 is pivotally connected to the inner end of a linking member 84, and the outer end of the member 84 is nonrotatably secured to the actuation rod 66 of the adjacent valve. Thus, as viewed in FIG. 4, when the control rod 76 is moved inwardly, the unison ring 68 is rotated in a counterclockwise direction, the linking members 82 are rotated in a clockwise direction, and the linking members 84 are rotated in a counterclockwise direction, thereby simultaneously rotating each of the valve actuation rods 66 in a counterclockwise direction. In a like manner, outward axial movement of the control rod 76 causes simultaneous clockwise rotation of the actuation rods 66.

When the valves 60 are moved to their open position, compressor discharge air 20 in the plenum 56 is forced into the combustion flow passage 54 through circular swirl plates 86 positioned in each of the liner end wall openings 64. Each of these swirl plates has, around its periphery, vaned swirl slots 88 which impart to the air 20 entering the liner interior an axially and tangentially directed swirl pattern as indicated in FIG. 3. The fuel 24 is introduced into the combustion flow passage 54 for mixture with the swirling air 20 by means of a circumferentially spaced series of stageable, fuel nozzles 90, to each of which is connected a pair of fuel supply lines 92, 94 extending inwardly through the outer combustor housing sidewall 38.

As illustrated in FIGS. 3 and 4, each of the nozzles 90 projects radially into the upstream portion of the combustor liner 44, through liner sidwall 48, downstream from the liner end wall 46. Directly across the flow passage 54 from the nozzles, and radially spaced therefrom, is an axial portion 96 of liner sidewall 50 which projects radially into the liner interior 54 around the entire circumference of sidewall 50. The inwardly projecting liner wall portion 96 has an annular, inclined wall section 98 which generally faces the liner and wall 46, and an oppositely facing annular, inclined wall section 100. Circumferentially spaced series of air inlet openings 102, 104 (only one opening of each series being shown in FIG. 3) are formed respectively through sidewall section 100 and liner sidewall 48 (immediately downstream of nozzles 90) around their circumferences. These inlet openings are sloped in a downstream direction and serve as dilution air openings for admitting pressurized combustion discharge air 20 into the combustion flow passage 54 from the plenum 56. Admission of such dilution air functions in a generally conventional manner to provide a substantially uniform hot discharge gas temperature profile at the combustor discharge opening 52.

As will now be described, the nozzles 90 and the inwardly projecting liner wall portion 96 uniquely cooperate to substantially improve the ignition stability of the combustor 22. Additionally, the variable geometry feature of the combustor (i.e., the simultaneously controlled inlet valves 60) substantially improve its ground start, high altitude relight, and lean stability capabilities. Together these two novel features of the combustor permit it to be operated safely and efficiently within the expanded flight envelope portion 32 illustrated in FIG. 2—an operating area well beyond the limitations of conventional fixed geometry combustor apparatus.

The nozzles 90 and projecting liner wall portion 96 cooperatively define within the combustion flow passage 54 a partial barrier which generally divides an upstream portion of the flow passage into a pilot combustion zone 54*a* between the nozzles and the liner end wall 46, and a main combustion zone 54*b* immediately downstream from the nozzles. These two axially spaced combustion zones are each of an annular configuration and communicate through the radial gaps between the nozzles and liner wall portion 96 and the circumferential gaps between the nozzles.

Upon initial startup of the turbine engine 10, the combustor valves 60 are brought to their fully closed position by the unison ring actuation system as previously described, and fuel 24 is sprayed into the pilot combustion zone 54*a*, via fuel lines 94, through pressure atomizing outlet heads 106 positioned on each of the nozzles 90. As indicated in FIG. 3, fuel 24 sprayed from each head 106 is directed generally toward the liner end wall 46, at a radially inwardly sloped angle. Combustion within the pilot zone 54*a* is inititated by conventional igniter means 108.

The engine may then be brought to within its normal operating range by opening the valves 60, thereby forcing the swirling air 20 into the combustion flow passage, and spraying fuel 24 into the main combustion zone 54*b*, via fuel supply line 92, through air blast fuel nozzle heads 110 positioned on each of the nozzles 90 and directed into the main combustion zone at a radially inwardly sloped angle. The fuel spray heads 110 are of the air blast type and, in a conventional manner, mix compressor discharge air 20, from the plenum 56, with the sprayed fuel 24 as indicated in FIG. 3. With the introduction of the swirling air 20, and the fuel sprays from heads 106, 110, continuous combustion is maintained in each of the axially spaced combustion zones 54*a*, 54*b*.

During operation of the combustor, the nozzles 90 and the liner wall portion 90 cooperate to "shelter" the combustion process in the pilot zone against adverse interaction with the combustion process in the main combustion zone, and additionally shelter it from sudden back pressure within the flow passage 54.

As an example, if fuel flow to the heads 110 is abruptly terminated to sharply reduce the engine power level, the combustion in main zone 54*b* is equally abruptly terminated. In conventional fixed geometry combustors, such a rapid dimunition in total combustor fuel supply can tend to extinguish all combustion—especially when the combustor is operated outside the design flight envelope 28. However, in combustor 22 this undesirable result is substantially eliminated because a large portion of the combustion flow passage area through which the main combustion zone extinguishment effect could be transmitted to the pilot zone is physically blocked by the nozzles 90 and liner wall portion 90. Such sheltering of the pilot zone by the nozzle and liner wall partial barrier also protects against extinguishment of combustion in the pilot zone in instances where the combustion flow passage experiences a sudden back pressure caused, for example, when the engine experiences a stall condition.

From the above, it can be seen that the novel structural arrangement of the nozzles and liner wall portions 90, 96 of combustor 22 substantially enhances its ignition stability. It is this aspect of the present invention which permits normal operation (i.e., full combustion within each of the zones 54*a*, 54*b*) of combustor 22 within the expanded flight envelope portion 32.

The variable geometry combustor intake valve system provides an additional measure of reliability and safety within the envelope zone 32 by greatly improving the high altitude relight capability of the combustor. In the event that the pilot zone combustion is extinguished during flight, the intake valves 60 are simply moved to their fully closed positions, thereby shutting off all combustor air supply through the swirlers 86. This instantly maximizes the fuel richness within the pilot zone 54*a*, permitting rapid relight of the combustor and a return of the engine to normal power output levels. Such richness maximization capability also improves the ground start capabilities of the engine under low ambient temperature conditions.

In summary, the present invention provides improved combustor apparatus and associated methods which permit a gas turbine propulsion engine to be safely and reliably operated well beyond the altitude and mach number limits heretofore imposed by fixed geometry combustors.

The foregoing detailed description is to be clearly understood as given by way of illustration and example only, the spirit and scope of this invention being limited solely by the appended claims.

What is claimed is:

1. A method of operating a gas turbine engine combustor having a liner which internally defines a combustion flow passage in said combustor, said method comprising the steps of:

(a) flowing a selectively variably quantity of combustion air into said flow passage through an upstream end wall portion of said liner;

(b) imparting a swirling flow pattern to the combustion air entering said flow passage; and (c) injecting fuel into said combustion flow passage through nozzle means projecting into said flow passage, through a sidewall portion of said liner, downstream from said end wall portion and positioned in the path of the swirling combustion air, said fuel injecting step being performed by providing said nozzle means with means for selectively spraying fuel from said nozzle means in an upstream direction, a downstream direction or simultaneously in upstream and downstream directions, and operating said means for selectively spraying fuel.

2. A method of operating a gas turbine engine combustor having an upstream end wall with a sidewall portion extending downstream therefrom and defining therewith a combustion flow passage, said method comprising the steps of:

(a) injecting fuel into said flow passage through nozzle means projecting thereinto through said sidewall portion downstream from said end wall to partially block said flow passage, said fuel injecting step being performed by providing said nozzle means with means for selectively spraying fuel from said nozzle means in an upstream direction, a downstream direction or simultaneously in upstream and downstream directions, and operating said means for selectively spraying fuel;

(b) flowing a selectively variable quantity of combustion air into said flow passage in a downstream direction through opening means formed in said end wall; and (c) flowing dilution air into a portion of said flow passage positioned downstream from said nozzle means.

3. The method of claim 1 comprising the further step of configuring a section of said sidewall portion generally opposite said nozzle means to project into said flow passage in the path of combustion air entering said flow passage through said opening means.

4. The method of claim 1 wherein said opening means comprise a plurality of mutually spaced openings, and wherein said flowing step (b) is performed by operatively installing an inlet valve at each of said openings and simultaneously operating each of said valves.

5. The method of claim 2 wherein said step (b) includes forming a plurality of air inlet openings in said end wall, operatively connecting an inlet valve to said end wall at each of said openings, and providing means for simultaneously operating each of said valves.

6. The method of claim 5 comprising the further step of imparting a swirling flow pattern to air entering said flow passage thorugh said air inlet openings.

7. The method of claim 2 comprising the further step of configuring a section of said sidewall portion generally opposite said nozzle means to cooperate therewith in forming a barrier which shelters combustion in the portion of said flow passage positioned between said end wall and said nozzle means against back pressure in said flow passage or adverse interaction with combustion in said flow passage downstream from said nozzle means.

* * * * *